United States Patent [19]

Liska et al.

[11] Patent Number: 4,681,146

[45] Date of Patent: Jul. 21, 1987

[54] METHOD AND APPARATUS FOR PRODUCING ENGINEERED WOOD FLAKES, WAFERS OR STRANDS

[76] Inventors: Frank F. Liska; Frank T. Liska, both of, 1403 - 1770 Davie Street, Vancouver, B.C., Canada, V6G 1W4

[21] Appl. No.: 728,482

[22] Filed: Apr. 29, 1985

[30] Foreign Application Priority Data

May 22, 1984 [CA] Canada ..... 454792

[51] Int. Cl.[4] ..... B27L 5/02; B27L 7/00

[52] U.S. Cl. ..... 144/369; 144/162 R; 144/176; 144/3 R; 144/380; 241/296; 430/945

[58] Field of Search ..... 144/3 R, 43, 162 R, 144/162 A, 163, 172, 174, 176, 367, 369, 373, 380; 430/945; 241/296, 278 R

[56] References Cited

U.S. PATENT DOCUMENTS

| | | | |
|---|---|---|---|
| 2,796,094 | 6/1957 | Himmelheber et al. | 144/176 |
| 3,237,663 | 3/1966 | Kirsten | 144/176 |
| 3,335,771 | 8/1967 | Ledeizgerber | 144/176 |
| 4,176,800 | 12/1979 | Brewer | 144/172 |

*Primary Examiner*—W. D. Bray
*Attorney, Agent, or Firm*—Fetherstonhaugh & Co.

[57] ABSTRACT

Square or rectangular clean cut flakes, wafers or strands of a uniform thickness, width and length, with edges extending at right, acute or obtuse angles to the surfaces are produced by an apparatus in four distinct operations, comprising the veneer slicing, cutting of the veneer sheets into veneer strips, chemical or laser beam treatment and flake cutting. The chemical or laser beam treatment is applied to the edges of the veneer strips which run transversally to the direction of wood fiber and the application takes place before the veneer strips are cut into flakes. The treatment may be introduced for the purpose of sealing of the opened ends of wood fiber against water or water vapour absorption or to fortify and strengthen the flakes, wafers or strands against breakage along the wood fiber, to enhance the properties of the flakes, wafers or strands for the purpose of effective orientation in an electrostatic field or in other means of orientation in the production of agglomerated structural boards and lumber, to enhance the detectability of the position and degree of orientation of the flakes for the purpose of quality control, to color-code the flakes, wafers or strands for aesthetical, decorative or other reasons dictated by the manufacturing process or by the market. The moisture content and the mass of the flakes produced may be accurately monitored and the measurements processed in a computer and used for an effective control of the drying process.

10 Claims, 12 Drawing Figures

METHOD AND APPARATUS FOR PRODUCING ENGINEERED WOOD FLAKES, WAFERS OR STRANDS

This invention relates to the process, apparatus and production of high quality flakes, wafers and strands for the manufacturing of agglomerated structural boards and lumber. The edges of flakes, wafers or strands transversal to the wood fiber may be sealed or treated with chemicals or laser beams.

In the contemporary art of production of large wood flakes, for the agglomerated structural boards, the rotating disc type slicing apparatuses are preferably used. This is because the drum type flakers generate excessive amounts of small, undesirable particles and dust and are, therefore, used mostly for the production of flakes which are further reduced into tiny wood particles in the production of particleboard.

In the disc type flakers the slicing blades are disposed in the slicing tool of a flat, round disc. The slicing blades may be serrated, that is, have the cutting edges interrupted so that only one half of the thin veneer is sliced from the total surface of the logs presented to the surface of the slicing tool. The thin veneer is sliced in the form of curved strips. The other half of the thin veneer is sliced by the following slicing blade, again in the form of curved strips. Therefore, slicing of one thin layer of veneer from the logs requires two slicing blades.

Another type of slicing and veneer separation into curved strips is done by the application of grooving knives which cut concentric grooves into the surface of the logs presented to the surface of the slicing tool. A single edge slicing blade following the grooving knives then slices all the curved veneer strips. For the slicing of one single layer of veneer from the logs, one set of grooving knives and one slicing blade are required.

In both cases the slicing blades run, generally, in radial direction from the center of rotation to the circumference of the slicing tool. Logs are presented to the slicing tool in such a way that the slicing blades and the wood fiber of the logs run, substantially, parallel to each other during the slicing process, therefore, the slicing blades run transversally to the direction of slicing. The veneer strips are then randomly broken due to the bending of the veneer strips in the slicing blade recess made in the disc of the slicing tool. Furthermore, the grooving knives and the slicing blades impart rocking motion to logs, thus exerting unwanted forces on the veneer being cut. The surface of the flakes is then rough, uneven, the edges of the flakes are ragged and a high percentage of dust is generated. The length of the flakes varies and their shape is irregular, often with deep checks. The checked and partially split flakes interlock with each other and thus create problems in the storage and metering bins as well as in the dryers and the apparatuses for the orientation of strands in the production of structural boards. Similarly, the variable shape, thickness, length and width together with the ragged edges of the flakes interfere with the required smooth transportation and handling of the flakes.

The variable thickness of the flakes reduces the flaking capacity of the apparatus and affects adversely the quality of boards as well as increases the resin and wax consumption in the board production.

Wood dust and small particles must be separated from the large flakes, otherwise, the consumption of resin and wax will increase again and the quality of boards will decrease. Also the lost wood mass, due to the generation of wood dust, must be made up by feeding more logs into the flaker thus reducing the overall capacity of the flaker.

Maintenance, sharpening and manipulation of the slicing blades and the scoring knives, is costly and time consuming.

Currently, it is impossible to introduce any kind of chemical or other treatment to the edges of irregular and ragged flakes produced with the existing types of flakers.

Finally, it is completely impossible with the existing types of flakers to make clean cut and uniform long, rectangular strands for the production of agglomerated oriented lumber. These strands must be uniform in length, width and thickness. The ratio of the strand thickness to the strand length should be at least one to one hundred and fifty, that means, for the preferred thickness of three millimeters the length should minimally be four hundred and fifty millimeters.

It is the object of our invention to provide a method and an apparatus for producing wood flakes, wafers and strands with clean cut faces and edges in which the generation of dust is, practically, eliminated. Further objects of our invention are as follows:

Firstly, to provide a method and an apparatus to produce flakes and wafers of a square or a rectangular shape, uniform in thickness, length and width for the production of structural agglomerated boards, and also to produce long and wide strands for the production of agglomerated lumber with oriented strands.

Secondly, to provide a method and an apparatus in which the thickness, length and width of the produced flakes, wafers or strands may be easily changed to suit the requested properties of the structural agglomerated board manufactured or according to the market demands for the aesthetical appearance of the board surface.

Thirdly, to introduce chemical or other pretreatment to the edges transverse to the fiber of all flakes, wafers and strands to fortify them against splits and checks or for other reasons as described in the description of the apparatus and in the appended claims.

Fourthly, to provide a method and an apparatus for the production of flakes, wafers and strands which, together with a special design of the slicing tool, will eliminate the rolling over and rocking of logs during the slicing process and ensure smooth slicing by securing a forceful interlock of logs into a solid pile of logs in the log infeed pocket.

Fifthly, to provide a method and an apparatus in which the slicing and cutting blades are of a disposable type and are easy to change.

Further objects of our invention will appear from a detailed description of a number of embodiments of our invention described hereinafter with reference to the drawings. It is to be understood that the present invention is in no way limited to the detais of such embodiments but is capable of numerous modifications within the scope of the appended claims.

Figure 1:
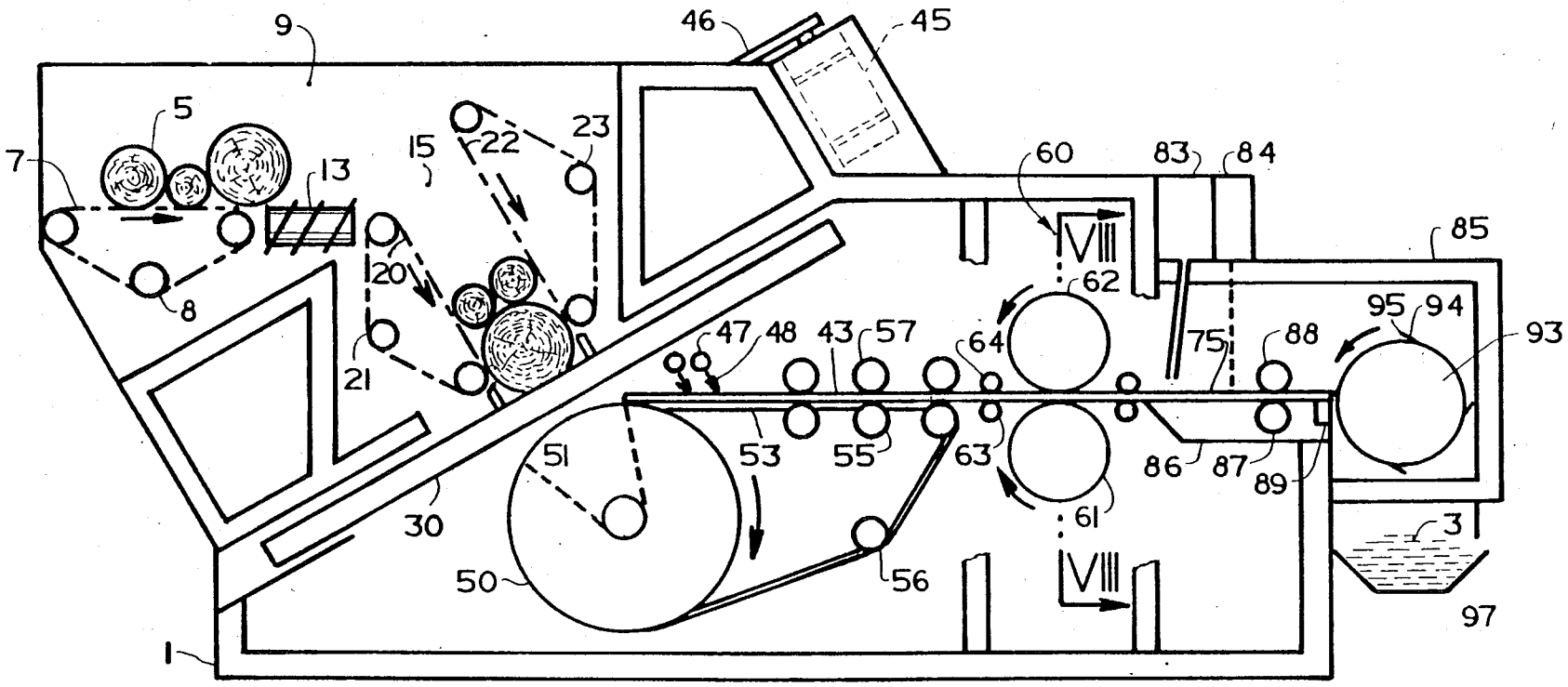
FIG. 1 is a diagrammatic side view of an apparatus for producing wood flakes, wafers or strands embodying the invention, the individual flakes, wafers or strands being produced in four separate processes.

A preferred embodiment of the novel apparatus for the production of square or rectangular wood flakes, wafers or strands is illustrated diagrammatically in FIG. 1. The frame 1 of this apparatus is illustrated diagrammatically only and need not be described in detail. The wood flakes, wafers or strands are indicated at 3.

Flakes, wafers or strands are produced by slicing the starting material, which has the form of substantially cylindrical logs 5, cut to a predetermined length. These logs 5 are placed on the infeed chain conveyor 7, one after the other, in a parallel relationship, in a substantially horizontal plane. The infeed chain conveyor 7 is disposed in the infeed trough 9.

Figure 2:
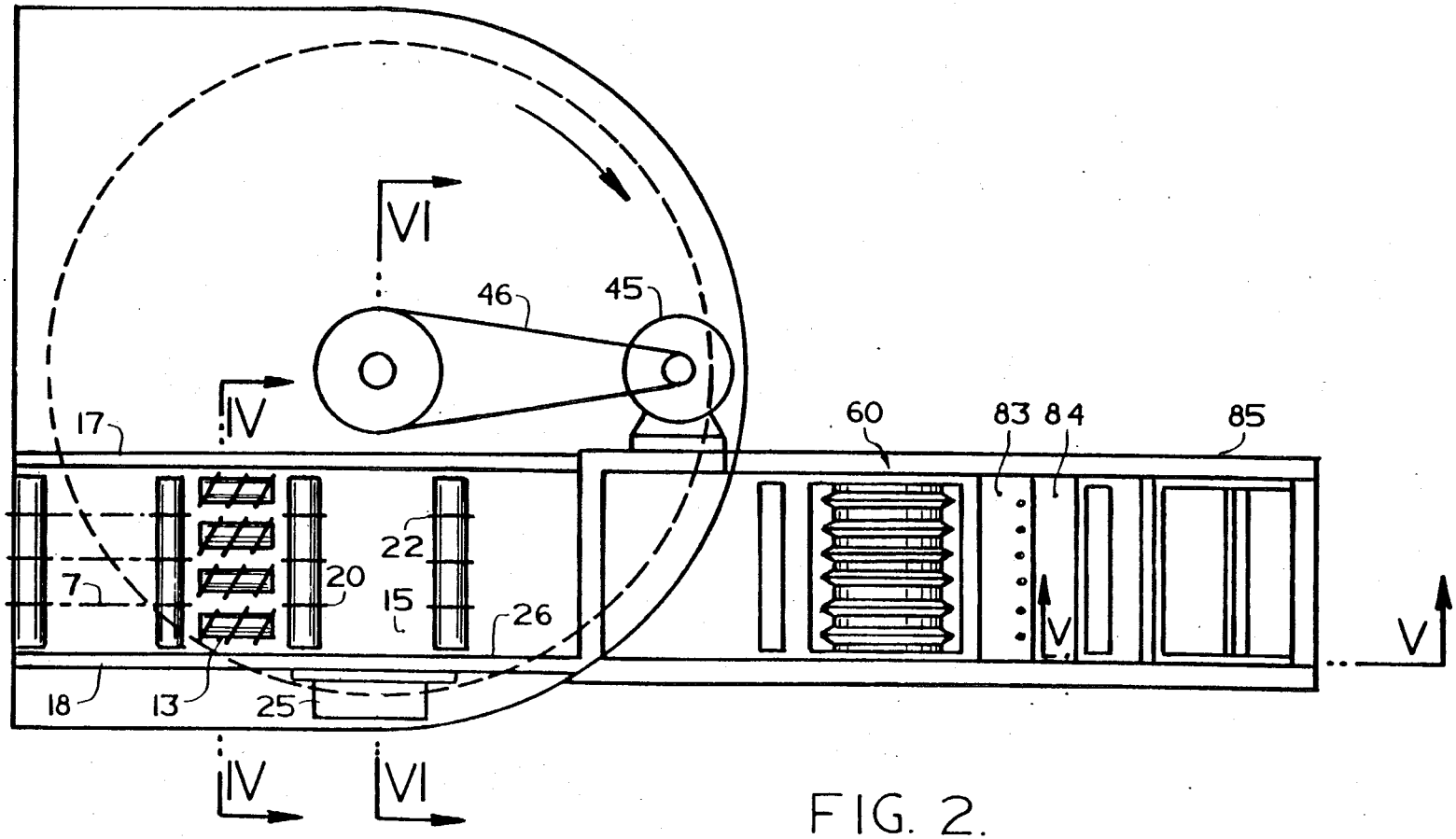
FIG. 2 is a plan view of the apparatus shown in FIG. 1.
Figure 4:
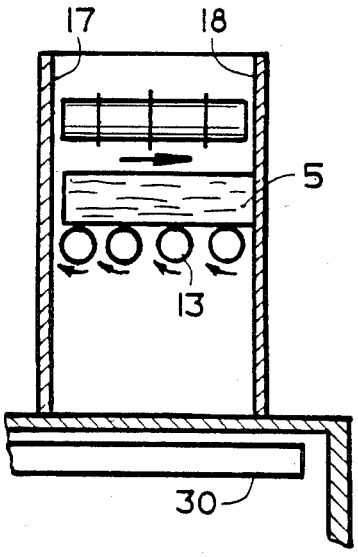
FIG. 4 is a partial sectional view illustrating the function of the ending rolls, the section being taken along the plane IV—IV of FIG. 2.

In the embodiment shown in FIGS. 2 and 4, logs 5 are carried to a set of ending rolls 13, disposed in the same infeed trough 9. The rotating ending rolls 13 extend in the same direction as the log infeed chain conveyor 7. The spiral ridges, disposed on the circumference of the ending rolls 13, move the logs 5 forward to the log infeed pocket 15 and simultaneously away from the wall 17 to the outside wall 18 of the log infeed trough. The logs 5 are placed then again in a parallel relationship so as to form a pile in the log infeed pocket 15. Suitable holding means are provided for holding the pile and for presenting it to one side of the slicing tool 30.

In the embodiment shown in FIG. 1, FIG. 2, FIG. 3, and FIG. 5, such holding means, disposed in the log infeed pocket, are formed by a pair of parallel sets of feed chains 20 and 22 and a third set of chains 24, located in the cleaning doors 25, the doors being disposed in the outside wall 26 of the log infeed pocket 15.

Figure 5:
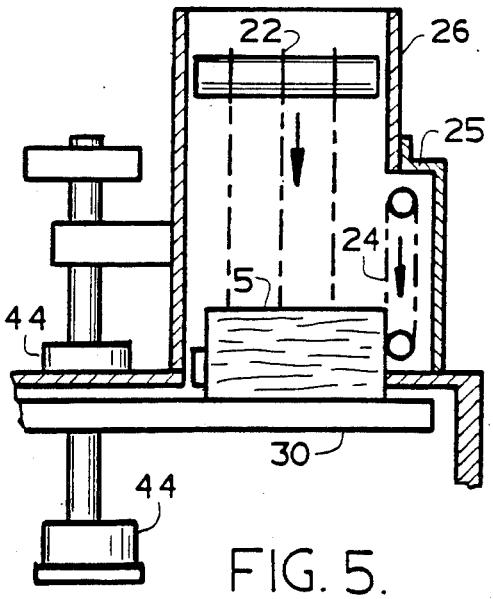
FIG. 5 is a partial sectional view of the log infeed pocket, the section being taken along the plane VI—VI of FIG. 2.

All sets of chains are provided with spikes capable of engaging with the pile of logs 5 in the log infeed pocket 15. The set of chains 20 and the set of chains 22 engage with the circumferential surface of the logs 5, interlocking logs 5 tightly one against the other. The third set of feed chains 24, disposed in the cleaning doors 25, in the outside wall 26 of the log infeed pocket 15, engages with the end face of the pile of logs as shown in FIG. 5. The set of chains 22 may be relocated closer to the set of chains 20 to form a narrower log infeed pocket, even to accomodate, when required, a stack of logs located in a single file, one above the other.

The third set of chains 24, FIG. 5, engaged with the end face of the pile of logs, holds against the pressure generated by the slicing edges during the veneer slicing process, and thus eliminates the friction between the faces of logs and the outside wall 26 of the log infeed pocket 15.

The feed motions of the sets of feed chains 20,22,24 are identical to ensure a firm grip on the pile of logs and thus a uniform thickness of the sliced veneers. The chain tighteners 8,21,23 correspond to the set of chains 7,20,22 respectively. Suitable electrical motors, providing the motion of the infeed chain conveyor 7, the ending rolls 13 and the relative feed motion between the log holding and feeding set of chains 20,22, 24 and the veneer slicing tool 30, for successive slicing of thin veneer sheets of wood from the bottom of the log pile, are not shown.

In lieu of the log infeed set of chains 20,22,24 other suitable feeding means may be provided, such as rolls with spring loaded discs or other conveying means.

Figure 3:
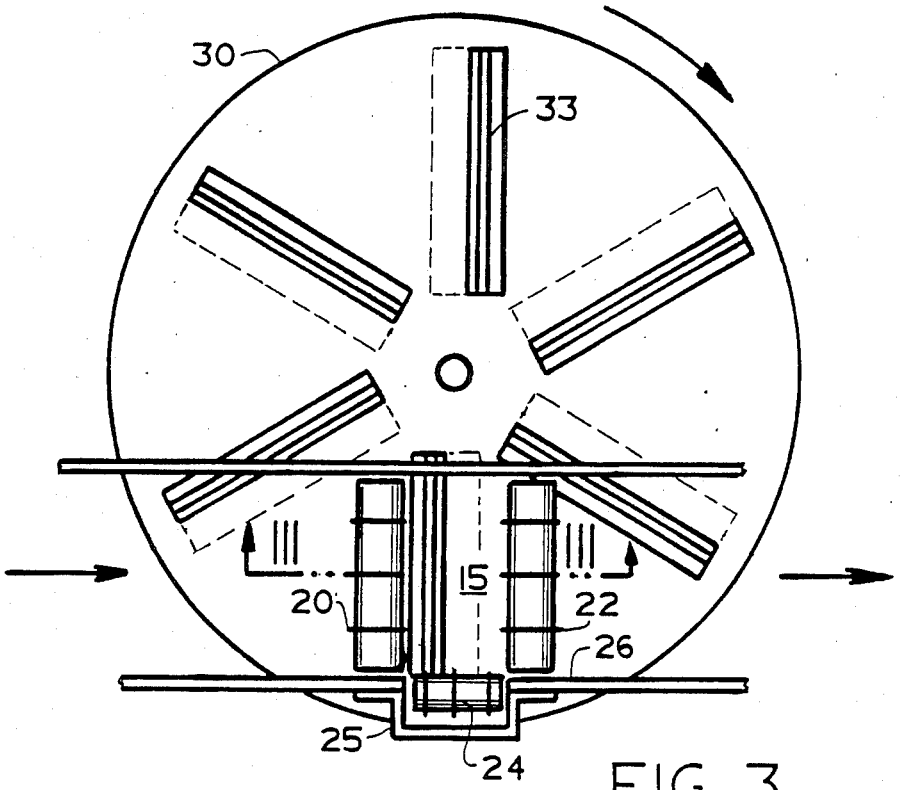
FIG. 3 is a plan view of the rotary disc shaped slicing tool of the apparatus shown in FIG. 1 and of the elements of the log infeed pocket disposed thereabove.
Figure 7:
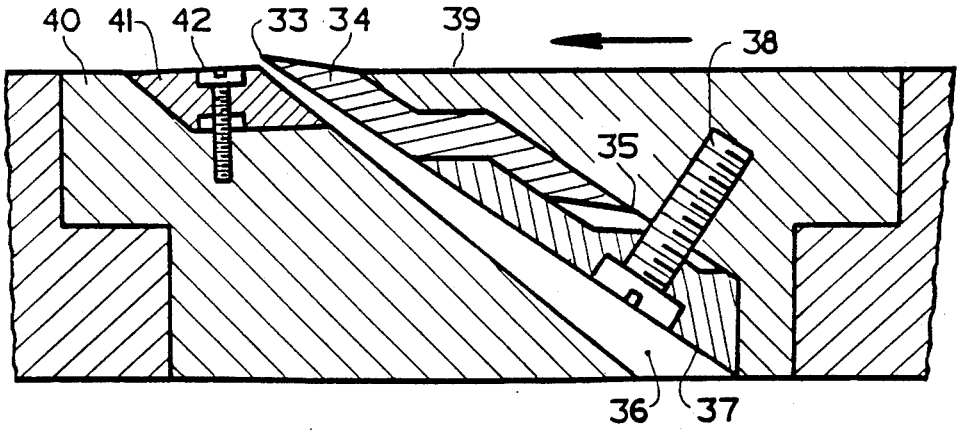
FIG. 7 is a partial sectional view of the slicing tool shown in FIG. 6, the view being on an enlarged scale.

An important feature of the present invention is the use of a particular type of slicing tool consisting of a substantially disc shaped rotary slicing tool 30, provided with at least one slicing edge 33 FIG. 3 and FIG. 7, but preferably with six or more slicing edges, disposed on the slicing blades 34 FIG. 7, which are spaced at uniform angles on the slicing tool 30 FIG. 3. The number of slicing edges is carefully selected according to the requested output of the apparatus, wood species of the logs 5 and with regard to the quality of the sliced veneers. Ideally only one slicing edge should be engaged in slicing when passing under the pile of logs.

Figure 6:
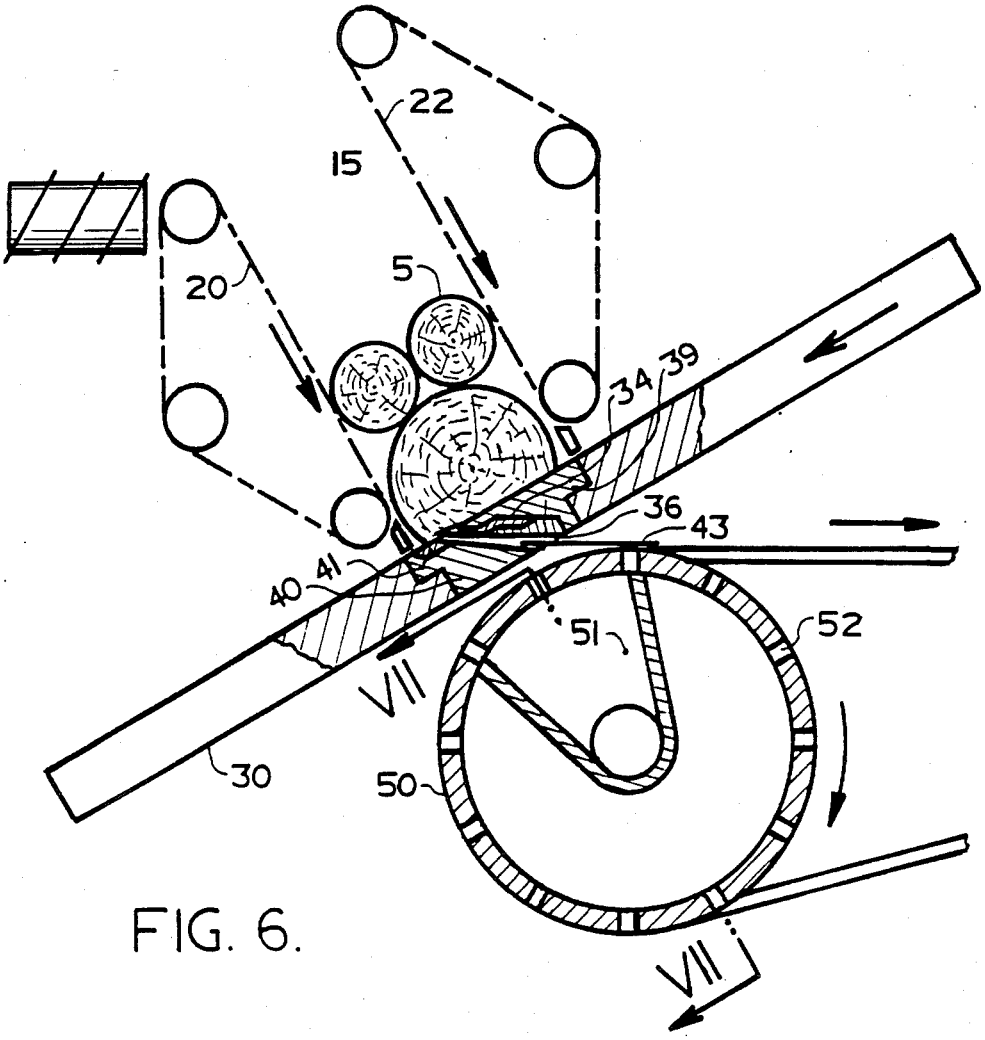
FIG. 6 is a partial sectional view of the slicing tool, veneer assembly drum and the log infeed pocket shown in FIG. 1, FIG. 2 and FIG. 3, the section being taken along the plane III—III of FIG. 3, the view being on an enlarged scale.

Each slicing blade 34 FIG. 6 and FIG. 7 is provided with two slicing edges 33 and 35. The blades 34 are so mounted that their slicing edge 33 or the slicing edge 35 project above the top surface of the disc 30. After the slicing edges 33 projecting above the disc 30 are blunted, the blades 34 are turned over and the other slicing edges 35 project above the top surface of the disc. After both slicing edges are blunted in the course of the veneer slicing process, the blades 34 are replaced by a set of new ones. Each blade 34 is fixed to the disc by a suitable clamping means 37, the screws 38 and the insert 39.

Forwardly, in the direction of rotation of the slicing tool, the aperture in the slicing tool 30 contains the insert 40 with a doublesurfaced nosebar 41, fixed to the insert 40 by screws 42.

Insert 40 with the nosebar 41 and insert 39 with the blade 34 and the clamping means 37 form a recess 36 inclined with respect to the axis of rotation of the disc, converging towards the slicing edge 33. The recess 36 thus formed is adapted to receive thin veneer sheets 43 FIG. 6, sliced from the bottom of the lowermost logs 5 in such a way so as to guide the veneer sheets through the recess and past the bottom of the disc shaped tool as shown in FIG. 6.

The implementation of a doublesurfaced nosebar 41 FIG. 6 and FIG. 7 is another embodiment of the present invention. Its top surface rises slightly from the top surface of the slicing tool 30 towards the slicing edge 33. The adjacent surface to the top surface of the nosebar facing the blade 34 forms together with the top surface of the nosebar a counteredge which runs parallel to the slicing edge 33. The vertical distance between the counteredge and the slicing edge 33 varies with the distance from the center of rotation of the slicing tool 30. This distance is smaller close to the center of rotation of the slicing tool and widens towards the circumference of the slicing tool.

This feature allows the nosebar 41 to compress the wood mass in logs 5 before being sliced into veneer sheets, the higher compression being in the part closer to the center of rotation of the slicing tool 30, where the slicing velocity is lower, and the lower compression being in the part located closer to the circumference of the slicing tool 30, where the slicing velocity is higher. In this way the low slicing velocity is balanced by the higher wood compression and the lower compression is balanced by higher slicing velocity. This achieves a smoother surface and a better quality of the sliced veneer sheets 43.

While the top surface of the nosebar 41 compresses the wood mass before slicing takes place, the adjacent surface of the nosebar, which runs downwardly into the recess 36, compresses the veneer sheets while they are still connected to the bottom of the logs 5 being sliced, thus the veneer sheets are stiffened against splitting and tearing along the wood fiber.

The slicing blades 34 with their two slicing edges, as well as the nosebars 41 with their two counteredges are of a disposable type. They are not resharpened after all the edges are blunted or rounded but are replaced by a set of new ones, with resulting savings on resharpening, tool babbitting and the time consuming proper setting and fastening in the slicing tool 30.

The slicing tool 30, rotating preferably in the plane which is not horizontal as shown in FIG. 1, is fixed or integral with the shaft journaled in bearings 44, shown in FIG. 5. This shaft is geared to the pinion shaft of the electric motor 45 by a suitable transmission 46 as indicated in FIG. 1 and FIG. 2.

During the rotation of the slicing tool 30, its blades 34 slice successive sheets of veneer 43 of substantially equal thickness from the bottom of the pile of logs 5, the motors of the log infeed chains, disposed in the log infeed pocket 15, being operated at such a speed so as to ensure that the lowermost logs 5 are urged towards the top of the disc shaped slicing tool 30 FIG. 6.

Another embodiment of our invention shows the thin veneers 43 successively sliced from the lowermost logs 5 by the slicing blades 34 FIG. 6 being discharged from the recess 36 of the slicing tool 30, drop into the space below the slicing tool directly onto the surface of the veneer assembly drum 50 which rotates in the direction towards the veneer strip cutting apparatus.

In order to ensure that the veneer sheets 43, sliced successively from the pile of logs 5, are properly deposited on the veneer assembly drum 50, when they follow each other rapidly, air nozzles 47 FIG. 1 are provided in the space under the slicing tool, above the surface of the veneer assembly drum 50, so as to direct air jets in the veneer-depository direction. The jets issuing from the nozzles 47 are indicated by an arrow 48 FIG. 1.

Compressed air is continually supplied to the nozzles which are forwardly inclined in the direction of the veneer assembly drum 50. Furthermore,to ensure that the veneer sheets will be deposited tightly to the surface of the veneer assembly drum 50, the drum is provided with a stationary chamber 51 FIG. 1 and FIG. 6, disposed inside the rotating drum 50, body of which is provided with holes 52 FIGS. 6 and 8.

Thus the veneer sheets, deposited on the moving surface of the drum 50, are held down by the difference in the air pressure surrounding the drum outside and the lower air pressure inside the chamber 51. The increased friction between the veneer sheets and the surface of the drum, due to the air pressure difference, is important for the instantaneous acceleration of the veneer sheets after being released from the recess 36.

The force, holding down the veneers towards the surface of the veneer assembly drum due to the difference in the air pressure outside the drum 50 and inside the chamber 51, cancels out when the veneer sheets pass the topmost point on the veneer assembly drum 50 FIG. 1 and FIG. 6, due to the equalization of the air pressure inside and outside the drum 50.

The veneer sheets are then carried on a set of belts 53, supported by the belt rolls 55, to the veneer strip cutting apparatus 60. The veneer sheets are pressed down towards the belts 53 and the rolls 55 by suitable holddown means 57. The circumferential speed of the holddown means 57 corresponds to the speed of the belts 53 and the veneer assembly drum 50. The belts 53 are tensioned by a set of pulleys 56.

Figure 8:
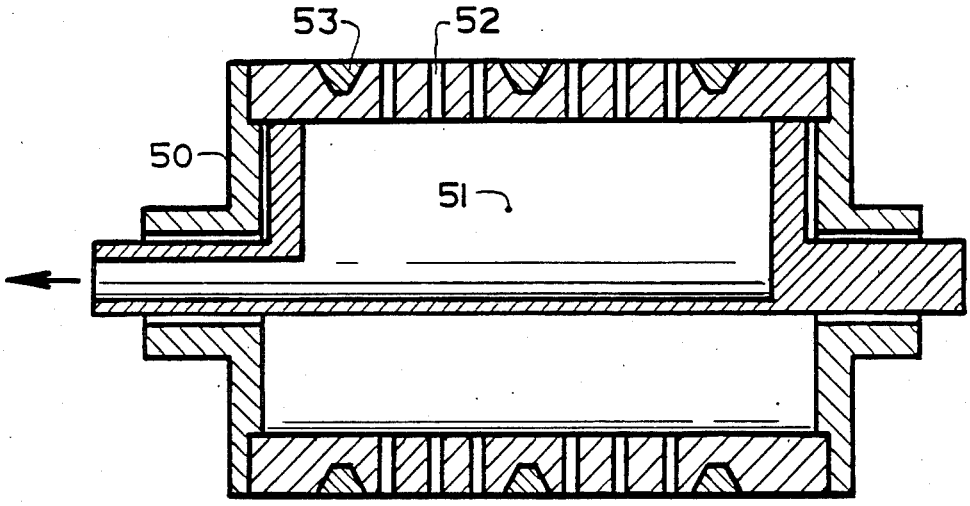
FIG. 8 is a sectional view of the veneer assembly drum shown in FIG. 1 and FIG. 6, the section being taken along the plane VII—VII of FIG. 6, the view being on an enlarged scale.

The basic construction of the veneer assembly drum 50 is shown in FIG. 8 in a section taken along the plane VII—VII of FIG. 6, where the drum is 50, the chamber with the negative pressure is 51, the belts are 53 and the holes drilled through the wall of the drum are 52.

The veneer strip cutting apparatus 60 FIG. 1 and FIG. 2 is another embodiment of this invention. The veneer sheets 43 leave the veneer assembly drum and the conveying means thereafter and enter the veneer strip cutting apparatus through the feed rolls. The bottom rolls 63 being the supporting rolls, the ones disposed above the supporting rolls 63 being the holddown rolls 64. The veneer sheets move at a preselected speed to the veneer supporting drum 61 and the veneer strip cutting tool 62. Whereas the drum 61 rotates in the direction of the moving veneers at the exactly same circumferential speed as all the other means which are in contact with the moving veneer sheets, the veneer strip cutting tool 62 may rotate at substantially higher circumferential speeds.

The action of the veneer strip cutting tool results in a clean cut in which the production of dust is, practically, eliminated.

Figure 9:
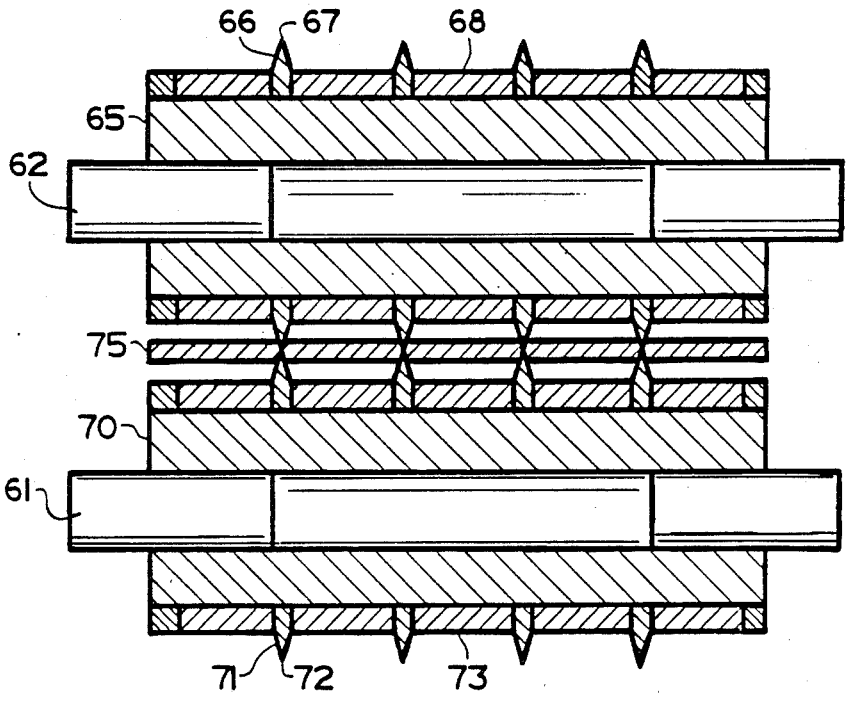
FIG. 9 is a sectional view of the veneer strip cutting apparatus shown in FIG. 1, the section being taken along the plane VIII—VIII of FIG. 1, the view being on an enlarged scale.

FIG. 9 represents a sectional view of the veneer strip cutting tool 62 and the veneer supporting drum 61, the section being taken along the plane VIII—VIII FIG. 1. This embodiment shows the veneer sheets cut transversally to the wood fiber into the veneer strips by a composite tool comprising a drum 65 which carries on its circumference a set of ring shaped blades 66 with a sharp circumferential cutting edge 67. Suitable spacing rings 68 are provided to hold the blades 66 in a preselected position which corresponds to the distances of the counterblades 71 disposed on the veneer supporting drum. The distances between the blades 66 correspond, therefore, to the width of the veneer strips 75 and, consequently, to the length of the flakes, wafers or strands measured in the direction of wood fiber.

The veneer supporting drum 61 consists of a rotary drum 70 which carries on its circumference a set of ring shaped counterblades 71 with a sharp circumferential cutting edge 72. Suitable spacers 73 are provided to hold the counterblades 71 in the position opposite to the blades 66 of the cutting tool 62.

If the cutting edges 67 of the veneer strip cutting tool 62 rotate at the speed corresponding to the circumferential speed of the cutting edges 72 of the veneer supporting drum 61, the veneers 43 are cut into veneer strips 75 in a scissor-like action of the cutting edges 67 and the cutting edges 72.

The cutting edges 67 of the veneer strip cutting tool 62 may also rotate at higher speeds than the speed of the cutting counterblade 71 of the veneer supporting drum 70, so that friction type cutting takes place. The friction type cutting reduces cutting forces, makes the edges of the veneer strips smoother and, therefore, the edges of the flakes, wafers or strands transversal to the wood fiber will also be smoother. This will have a beneficial effect on the quality of the final product, which is the agglomerated structural board and the agglomerated lumber.

The cutting blades 66 are made of a material which resists temperatures and cutting pressures generated by the cutting blades while cutting through the veneer sheets, and dissipates the heat into the body of the drum 65 and into the atmosphere. Both systems of cutting the veneer into strips do not generate any wood dust.

The cutting blades 66 may be replaced by a set of thin sawblades and counterblades 71 by a set of suitable veneer supporting rings, if required. However, in this case a small amount of sawdust will be generated.

Figure 10:
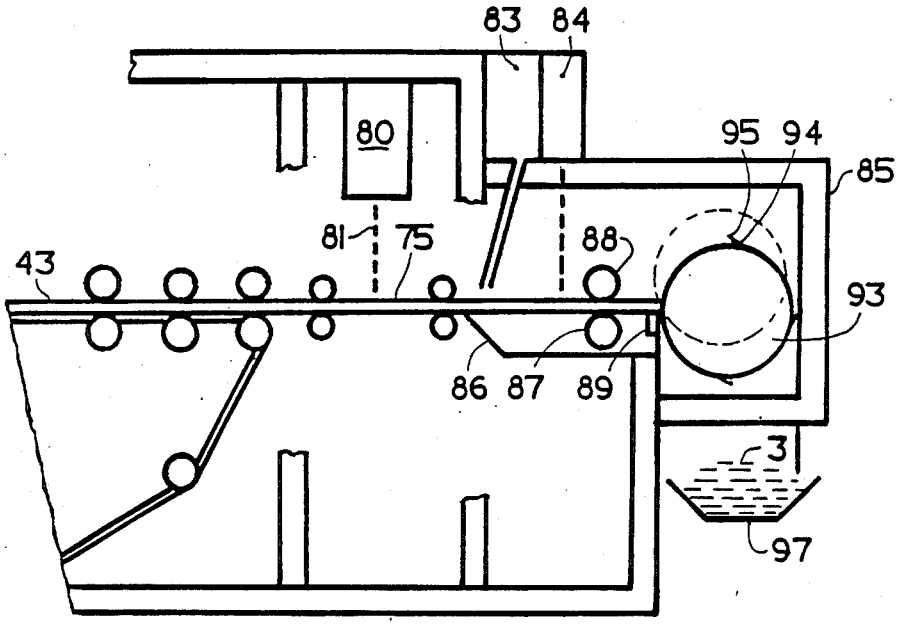
FIG. 10 is a diagrammatic side view of the laser veneer strip cutting apparatus, veneer strip edge sealing treatment apparatus, moisture content and wood mass measuring apparatus and the rotary drum flake cutting apparatus.

FIG. 10 shows another embodiment of this invention in which the supporting drum 61 and the veneer strip cutting tool 62 are replaced by a set of laser apparatuses 80 emitting laser beams 81, which cut the veneer sheets 43 into veneer strips 75. Very little of the wood substance is lost and the cut is smooth as in the case of the friction cutting described hereinabove.

The laser apparatuses 80 FIG. 10 may be replaced by a set of high pressure nozzles issuing narrow jets of liquid, which cut the veneers 43 into veneer strips 75.

The design of the veneer strip cutting apparatus 60 FIGS. 1, 2 and 9 allows changing of the width of the veneer strips 75 and, consequently, the length of flakes, wafers or strands, simply by changing the number and spacing of the cutting blades 66, the counterblades 71 and the spacers 68 and 73 as shown in FIG. 9, or by changing the number and spacing of the laser apparatuses 80, or the nozzles issuing high pressure jets as shown in FIG. 10. None of the above mentioned size controls can be achieved by any of the apparatuses currently used by the industry for the production of flakes, wafers or strands.

This feature of our invention gives the user the advantage of a quick response to the demands of the market, especially in the production of decorative waferboard with a variety of sizes of wafers, or in the production of agglomerated structural board and lumber, where longer strands for better quality are needed.

This feature is also very important for the smaller board manufacturing units, supplying local, limited markets, with a variety of demands on the quality and decorative appearance of the products.

Another embodiment of our invention, shown in FIGS. 1, 2 and 10 at 83, is the sealing treatment apparatus for the application of organic or inorganic chemicals, or a mixture of both to the ends of the wood fibers exposed in the kerfs made by the veneer strip cutting apparatus. The aim of the chemical treatment of the fiber ends in flakes, wafers or strands is to improve their resistance to the breakage along the wood fiber, especially during the drying process, to improve the sliding and the easiness of handling during further processing, to reduce the penetration of water and water vapour along the wood fiber, which is greatly higher than the penetration transversally to the wood fiber, to improve the properties of flakes, wafers or strands for the purpose of orientation in an electrostatic field or other means of orientation, to enhance the detectability of the position and the degree of orientation of flakes, wafers or strands in the board for quality control purposes, further, to colour the ends of flakes, wafers or strands for aesthetical or decorative purposes, or for colour coding of the manufactured boards or other unspecified purposes. The chemical treatment of the fiber ends described hereinabove can not be provided with any of the flakers currently available on the market.

Another embodiment of our invention, shown in FIGS. 1, 2 and 10 at 84, are the suitable means for measuring the moisture content and the wood mass of the veneer strips. The measured values of the moisture content and the wood mass of the veneer strips passing under the measuring apparatus are processed in a computer in order to find the ratio of water to the wood mass to instantaneously calibrate the performance of the flake dryer.

The embodiment of the flake cutting apparatus 85 is shown in FIGS. 1, 2, 10, 11 and 12. It comprises a veneer strip supporting table 86 with an inbuilt veneer strip feed roll 87, the hold-down means 88, disposed above the feed roll 87, and the stationary cutting blade 89 with four stationary cutting edges 90 FIG. 11, or the stationary cutting blade 91 with four stationary cutting edges 92 FIG. 12.

The rotary flake cutting tool 93 is of a drum type, mounted for rotation about a horizontal axis extending substantially parallel to the axis of the veneer assembly drum 50, the veneer supporting drum 61 and the veneer strip cutting tool 62 FIG. 1. The rotary flake cutting tool 93 has a plurality of circumferentially distributed disposable cutting blades 94, each with two cutting edges 95 and 96. The cutting edges 95 and 96 extend substantially parallel to the axis of rotation of the cutting tool 93. The horizontal shaft journaled in bearings mounted in frame 1, may be adjusted as is demonstrated in FIGS. 11 and 12.

Figure 11:
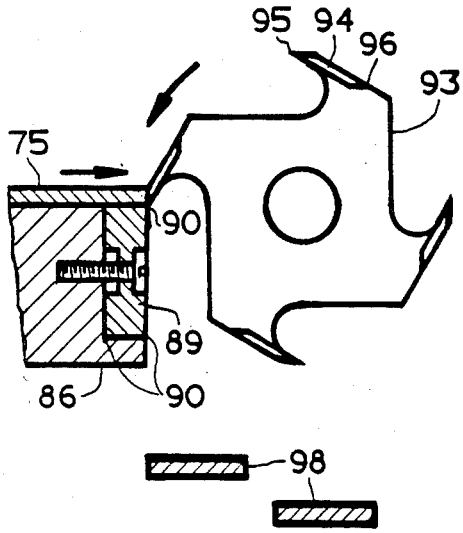
FIG. 11 is a sectional view of the rotary flake cutting tool and the rectangular stationary cutting counterblade shown in FIG. 1, FIG. 2 and FIG. 10, the section being taken along the plane V—V of FIG. 2, and simultaneously showing a cross-sectional view of the flakes, wafers and strands produced, the views being on an enlarged scale.

In FIG. 11 the axis of this shaft is disposed substantially parallel to the stationary cutting edge 90 in a horizontal plane, and the cutting edge 95 of the rotary cutting tool 93 cooperates with the stationary cutting edge 90.

Figure 12:
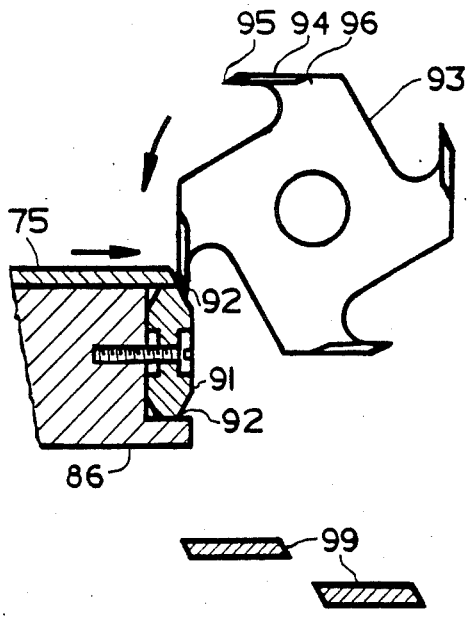
FIG. 12 is a sectional view of the rotary flake cutting tool and the modified stationary cutting counterblade shown in FIG. 1, FIG. 2 and FIG. 10, the section being taken along the plane V—V of FIG. 2, and simultaneously showing a cross-sectional view of the flakes, wafers and strands produced, the views being on an enlarged scale.

In FIG. 12 the axis of this shaft is disposed substantially parallel to and slightly above the level of the stationary cutting edge 92, and the cutting edge 95 of the rotary cutting tool 93 cooperates with the stationary cutting edge 92.

The stationary cutting blade 89 FIG. 11, respective the stationary cutting blade 91 FIG. 12, are so located as to slidingly receive the veneer strips from the veneer strip cutting apparatus 60 flowing to the flake cutting apparatus 85. Suitable means (not shown) are provided to impart rotation to the rotary flake cutting tool 93 causing its edges 95 to successively cut through the veneer strips 75 supported by the blade 89 FIG. 11, or the blade 91 FIG. 12, the cut extending downwardly, transversally to the direction of travel of the veneer strips, therefore, parallel to the fibers of the wood.

This again results in a clean cut in which no dust is produced.

The rotary speed of the flake cutting tool 93 is so correlated to the speed of the veneer sheets 43 and, consequently, to the speed of the veneer strips 75 that each of the cutting edges 95 cuts a set of flakes, wafers or strands from the leading edges of the veneer strips 75 flowing into the flake cutting apparatus 85, the flakes being of a predetermined width. The flakes, wafers or strands drop downwardly onto a conveyor 97.

The flakes, wafers or strands indicated in FIG. 1 and in FIG. 10 at 3 may be of a rectangular cross-section 98, as shown in FIG. 11. The cross-section of the flakes, wafers or strands 98 is taken transversally to the wood fiber of the flakes, wafers or strands.

The flakes, wafers or strands indicated in FIG. 1 and in FIG. 10 at 3 may be of a parallelogram cross-section 99, as shown in FIG. 12. The cross-section of the flakes, wafers or strands 99 is taken transversally to the wood fiber of the flakes, wafers or strands.

The operation of the apparatus described hereinabove is as follows:

After the motor 45 and all the other motors (not shown) FIG. 1, operating the conveying means for logs 5, the veneer sheets 43 and the veneer strips 75, the veneer strip cutting tool 62 and the flake cutting tool 93 have been started, the logs 5 are conveyed into the log infeed pocket 15. As soon as the lowermost logs 5 engage the slicing tool 30 and the log infeed pocket is filled with logs, the blades 34 FIGS. 6 and 7 slice successively thin veneer sheets 43 from the bottom of the lowermost logs 5. The slicing motion of the blades 34 runs substantially transversally to the wood fiber. The transmission 46 FIG. 2 may impart about 250 revolutions per minute to the slicing tool 30, resulting in the slicing of about 25 sheets per second of thin veneers from the lowermost logs 5.

The veneer sheets 43 drop upon the veneer assembly drum 50, rapidly and successively, in a single layer or in a multiple layer of veneers in an overlapping mode, which depends on the cooperatively related speed of the veneer sheet conveying means and the circumferential speed of the flake cutting tool 93.

The veneer sheets, laid on the surface of the veneer assembly drum 50, are held down by the force of suction generated by the negative pressure in the stationary chamber 51, located inside the perforated rotating drum 50, and by the pressure of air jets 48 issuing from the nozzles 47. This results in increased friction between the bottom surface of the veneer sheets and the surface of the veneer assembly drum. Thus the veneer sheets are accelerated to the circumferential speed of the veneer assembly drum in the direction opposite to the direction of slicing FIG. 3.

The veneer sheets are then conveyed at the speed corresponding to the circumferential speed of the veneer assembly drum to the veneer strip cutting tool 62, which cuts the veneer sheets in the direction of the movement of the veneers, that is, transversally to the direction of wood fiber, into a multiple of strips. The width of the strips is preselected and corresponds to the required length of the flakes, wafers or strands measured in the direction of wood fiber.

Thin kerfs made by the cutting blades 66 FIG. 9 of the cutting tool 62 or by the laser beams 81 FIG. 10 may be filled continually with chemicals for the improvement of the quality of the flakes, wafers or strands or for the purpose of further processing of the manufactured flakes, wafers or strands.

The moisture content and the wood mass of the veneer strips is continually measured by the metering apparatus 84 and the readings are stored in a computer memory for the purpose of further processing of the flakes, wafers or strands manufactured.

The veneer strips slide then towards the rotary flake cutting tool 93. When the veneer strips pass across the stationary cutting blade 89, they enter the path of the cutting edges 95. Each of these edges will cut through the veneer strips, thus continuously cutting flakes, wafers or strands from the leading edge of the veneer strips.

The width of the flakes, wafers or strands cut in this manner depends on the speed of operation of the veneer conveying means and on the number of flake cutting operations per time unit. This number again depends on the circumferential speed of the rotary flake cutting tool 93 and on the number of cutting edges 95 carried thereby.

From the above it will be readily understood that the method and the apparatus described above will attain the objects of the invention.

In the prior art of making flakes, wafers or strands with an apparatus having the rotary disc-like slicing tool, the logs presented to the surface of the slicing tool are rocked and rolled over during the slicing process, due to the lateral forces exerted by the multiplicity of the slicing blades, either the serrated type or those cooperating with the grooving knives. Thus the surface of the sliced veneer strips is rough and excessive amount of dust is generated.

Dust is also generated by the serrated blades or grooving knives. Additional amount of dust, small wood particles and wood splinters are generated when the curved veneer strips are randomly broken along the wood fiber into flakes, irregular in shape with ragged edges.

The thickness of the curved strips varies because several slicing blades are simultaneously involved in slicing action at the center of rotation of the slicing tool and thus prevent uniform and even presentation of logs towards the surface of the slicing tool. This unevenness in the log feeding system is compensated for by higher feeding forces exerted on the logs with the consequent increase in friction between the logs presented to the surface of the slicing tool as well as a higher requirement of energy for the rotating slicing tool.

The practice to spray water on the surface of the slicing tool to reduce the friction increases the water content in the flakes produced and the water must be later evaporated at additional expense.

Our novel system, dividing the production into four basic separate phases, ensures clean cut faces and edges and eliminates the generation of dust. These phases being, veneer slicing, veneer strip cutting, sealing treatment of edges transverse to the wood fiber and, finally, flake, wafer or strand cutting.

Logs, being positioned by the ending rolls towards the circumferential wall of the log infeed pocket, are not moved radially towards the circumference of the slicing tool by the lateral forces exerted by the slicing blades on the logs during slicing but are firmly supported by the log end feeding chains.

The design of the slicing blades and the double surface nosebars and their deposition on the slicing tool, eliminates the need for a forceful presentation of logs towards the surface of the slicing tool, thus minimizes the friction between the logs and the slicing tool and saves energy needed for slicing.

The unique design of the double surface nosebar eliminates the negative influence of the varying slicing speed along the slicing blade on the quality of the veneers. By varying the degree of compression of the wood fiber in logs before slicing and varying the degree of compression of the veneer sheets passing through the slot between the slicing blade and the double surface nosebar, veneers with smooth surfaces and without checks or splits are produced.

The veneer sheets are cut into veneer strips in a separate process, independent of the veneer slicing process. The veneer sheets are held firmly down against the veneer conveying system which advances the veneer to the veneer strip cutting tool. The cutting edges of the tool cut the veneers transversally to the wood fiber and separate the veneer sheets into veneer strips. In this process, in which scizzor-like cutting, friction type cutting by the blades or laser cutting is applied, no wood dust is generated. Furthermore, the edges with exposed wood fiber ends are not damaged and splits and checks along the wood fiber are eliminated.

The veneer strips are cut into flakes in yet another separate process, which is not directly dependent on the veneer slicing and veneer strip cutting. The flakes, wafers or strands are cut by a rotary flake cutting tool working transversally to the length of the veneer strips, that means, parallel to the wood fiber. This parallel cutting to the wood fiber requires less energy and does not generate any wood dust.

Through hereinabove described separate veneer slicing, veneer strip cutting and flake cutting, high quality flakes, wafers or strands are produced, which are uniform in thickness, length and width, square or rectangular in shape, with smooth and clean faces and edges, and the generation of wood dust is eliminated.

In the prior art of producing flakes, the thicker curved veneer strips sliced from logs break randomly and easily into splinters, while the thin veneer strips break randomly into wide and irregular flakes. No effective control over the width of the flakes can be applied. The length of the flakes can not be controlled either and will vary from zero to one and half of the required length which is given by the distances between the grooving knives or by the width of serrations of the serrated blades. The thickness of the curved veneer strips and, consequently, the thickness of the flakes may be changed only in the terms of the average thickness because the thickness of the flakes varies from the thin flakes, which are many times thinner than the requested flake thickness, to the very thick flakes, which may be twice as thick than the preselected thickness of flakes given by the height of projection of the slicing edge above the plane of the slicing tool.

Our novel apparatus enables an easy change of the flake, wafer or strand thickness by inserting the proper set of slicing blades and nosebars into the veneer slicing tool. The change of the flake, wafer or strand length is done by simple resetting of the veneer strip cutting blades and the veneer strip cutting counterblades or other cutting means as described hereinabove. The change of the flake, wafer or strand width is done by speeding up or slowing down of the flake cutting tool in relation to the speed of the veneer assembly drum.

In the prior art of wood flake making, the chemical or other type of pretreatment of the flake edges transversal to the direction of the wood fiber is not possible.

Our novel process enables the treatment of the edges of the flakes, wafers or strands transversal to the direction of the wood fiber by chemicals or with laser beams in order to fortify or strengthen the flakes, wafers or strands against breakage along the wood fiber, to reduce the water or vapour absorption, to enhance the properties of the strands for the purpose of effective orientation in the production of the agglomerated structural boards, to colour-code the flakes, wafers or strands for aesthetical or other reasons dictated by the market.

In the prior art of flake making, the slicing blades for the disc type flakers have to be resharpened after several hours of use and should be babbitted to the original width. Both actions are time consuming and costly. Human errors during servicing and installation must also be taken into account.

Our novel apparatus is equipped with a disposable type of slicing blades and nosebars, cutting blades and counterblades which enables a quick change, minimum loss in production time and ensures repeatedly the same slicing and cutting conditions and eliminates completely human errors.

Our novel apparatus can produce flakes, wafers or strands with rectangular cross-section transversal to the wood fiber and of a rectangular shape, they may be short or long, narrow or wide, thin or thick, of predetermined dimensions. Our apparatus can also produce flakes, wafers or strands with parallelogram type cross-section transversal to the wood fiber, which will improve the consolidation of the flakes, wafers or strands during the pressing process in the production of agglomerated structural boards.

It has to be stressed that flakes, wafers and strands produced on our novel apparatus, which have clean, smooth faces and edges, uniform thickness and size, will improve the economy of the production and the marketability of the agglomerated structural boards by:

elimination of wood dust generation with the consequent reduction of consumption of wood required for the production of the agglomerated boards or lumber, preserving the excellent quality of the boards at lower density due to the uniformity of the flake thickness and shape, thus reducing further the consumption of wood needed for production, reduction of the consumption of resin and other chemicals, enabling the accurate monitoring of the moisture content and mass of the flakes, wafers and strands produced for the purpose of controlling the function of the dryer and reduction of the drying expenses, introduction of new types of structural boards, agglomerated lumber and decorative boards on the market.

The embodiments of the invention in which an exclusive property or privilege is claimed are defined as follows:

1. A method for producing square or rectangular wood flakes from logs of predetermined length, said flakes being square or elongated in the direction of the wood fibers and having clean cut faces and edges, said flakes being of generally uniform predetermined thickness, uniform predetermined width and uniform predetermined length, the edges parallel to the wood fibers forming right, obtuse or acute angles with the face of said flakes and the edges transverse to the wood fibers forming right, obtuse or acute angles with the face of said flakes, the method comprising:

aligning said logs on a log infeed chain conveyor with the fibers of said logs extending transverse to the feed motion, feeding said logs into a log infeed pocket, confining said logs tightly in said pocket with three sets of log feeding chains, said chains preventing rolling and lengthwise shifting of said logs and imparting feeding motion to said chains, said chains all moving at the same speed, presenting the bottom logs confined in said log infeed pocket to the top of a rotary veneer slicing tool containing at least one slicing blade with doublesurfaced nosebars for successive slicing of veneer sheets, imparting a continual rotary slicing motion to said slicing tool and producing relative feed motion between said log feeding chains and said slicing tool, compressing the wood fiber of the bottom logs fed by said log feeding chains against the top of said slicing tool, the degree of compression varying gradually from a high compression at the center of rotation of said slicing tool to a low compression at the circumference of said slicing tool, slicing a veneer sheet from the bottom log during each pass of the slicing blade under said pile of logs, said slicing blade being substantially parallel to the direction of the wood fiber of the log being sliced and the slicing motion direction being substantially transverse to the wood fiber of said logs during the veneer slicing process, compressing the veneer during slicing from said bottom logs, the degree of compression varying gradually, from a high compression at the center of rotation of said slicing tool to a low compression at the circumference of said slicing tool, letting the veneers sliced from said logs pass through a recess in the slicing tool and drop onto a rotary veneer assembly drum rotating against the direction of the slicing motion of said slicing tool, towards the veneer strip cutting apparatus, said drum communicating with a source of suction, said veneers being directed by jets of pressurized air and held temporarily on the surface of said veneer assembly drum by the suction in said drum and the pressure exerted by the jets of pressurized air, imparting motion to said veneer sheets in the direction of the veneer strip cutting apparatus, the wood fiber of said veneer sheets extending parallel to the logs being sliced, parallel to the axis of said veneer assembly drum and transverse to the direction of veneer motion, transferring said veneer sheets from the veneer assembly drum to a veneer strip cutting apparatus on a set of belts running at a speed corresponding to the circumferential speed of said veneer assembly drum, holding down the veneer sheets on said set of belts during the transfer to the veneer strip cutting apparatus;

feeding said veneer sheets into a veneer strip cutting apparatus at a speed corresponding to the circumferential speed of said veneer assembly drum, cutting said veneer sheets transverse to the wood fiber into at least a single veneer strip continually moving said veneer strips through an edge sealing treatment apparatus at a speed corresponding to the circumferential speed of said veneer assembly drum, further, continually moving said veneer strips at the speed corresponding to the circumferential speed of said veneer assembly drum through a moisture content and wood mass measuring apparatus towards a rotary flake cutting tool, imparting cutting motion to said rotary flake cutting tool for successive cutting of the flakes by a plurality of circumferentially distributed cutting blades, the cutting direction extending substantially downwardly, transverse to the direction of travel of said veneer strips, parallel to the fiber of wood.

2. A method according to claim 1 wherein said logs aligned on the log infeed chain conveyor are shifted so as to move slidingly towards the circumferential set of feeding chains disposed in said log infeed pocket.

3. A method according to claim 1 wherein rolling of logs confined in said log infeed pocket is prevented by pressure acting transverse to the fiber of said logs, said pressure being exerted by two sets of feeding chains disposed in said log infeed pocket.

4. A method according to claim 3 wherein said lengthwise shifting of logs confined in said log infeed pocket is prevented by a third set of chains disposed in the wall of said log infeed pocket at the circumference of said slicing tool.

5. A method according to claim 1 wherein the veneer sheets drop successively onto the surface of the rotary veneer assembly drum in a single layer.

6. A method according to claim 1 including treating the edge of said veneer strips transverse to wood fiber by a process selected from the group consisting of treatment with an organic chemical, treatment with an inorganic chemical and treatment with a laser.

7. Apparatus for producing square or rectangular flakes from wood logs of predetermined length, said flakes being square in shape like wafers or elongated in the direction of wood fiber like strands, comprising:

a rotary substantially disk shaped veneer slicing tool provided with at least one but preferably several slicing blades with corresponding doublesurfaced nosebars, means for imparting rotation to said slicing tool, log infeed pocket disposed above said slicing tool and having means for holding tightly a pile or a single file stack of wood logs and means for presenting the bottommost logs to the top side of said veneer slicing tool, fiber of said logs being extended substantially transversally to the direction of rotation of said rotary veneer slicing tool, means for conveying and aligning said wood logs before entering said log infeed pocket, means for producing relative feed motion between said holding means and said rotary veneer slicing tool for causing the latter to slice successive veneer sheets from the bottom of said wood logs and to drop said veneers onto the surface of the hollow rotary veneer assembly drum disposed under said veneer slicing tool and having the axis of said drum extended substantially parallel to the direction of wood fiber of said logs, means for guiding sliced veneer sheets with jets of pressurized air towards the surface of said veneer assembly drum, said means for guiding being disposed under said veneer slicing tool, above said veneer assembly drum, means for exerting temporary suction pressure to the surface of said veneers dropped onto the surface of said veneer assembly drum, said suction pressure acting in the direction towards the axis of said veneer assembly drum, means for cancelling of said negative pressure, separating veneers from the surface of said veneer assembly drum and conveying the veneer sheets towards the veneer strip cutting apparatus, means for imparting acceleration and conveying motion to said veneers towards said veneer strip cutting apparatus, said motion so correlated to the circumferential speed of said veneer slicing tool as to allow said veneers to follow each other in close succession or in an overlapping mode, veneer strip cutting apparatus containing rotary veneer strip cutting tools with multiplicity of shearing cutting blades, cutting direction being transversal to wood fiber of said veneers, means for imparting rotation to said rotary veneer strip cutting tools, moisture content and wood mass measuring apparatus, flake cutting apparatus containing rotary flake cutting tool with a plurality of circumferentially distributed cutting edges extending substantially parallel to the axis of said flake cutting tool, mounted to perform cutting motion substantially transversally to the motion of advancing veneer strips and substantially parallel to the wood fiber of said veneer strips, means for imparting cutting motion to said flake cutting tool, cutting being substantially in downward direction.

8. Apparatus according to claim 7 including means to seal said veneer edge, said means being selected from the group consisting of means to treat with an organic chemical, means to treat with an inorganic chemical and means to treat with a laser.

9. Apparatus according to claim 7 wherein said rotary disk shaped veneer slicing tool rotates in horizontal plane.

10. Apparatus according to claim 7 wherein said rotary disk shaped veneer slicing tool rotates in a plane at an angle to the horizontal plane.

* * * * *